US007080691B1

(12) United States Patent
Kegin

(10) Patent No.: US 7,080,691 B1
(45) Date of Patent: Jul. 25, 2006

(54) PLUNGER LIFT TOOL AND METHOD OF USING THE SAME

(76) Inventor: Kevin L. Kegin, 118 E. Washington, Crescent, OK (US) 74028

( * ) Notice: Subject to any disclaimer, the term of this patent is extended or adjusted under 35 U.S.C. 154(b) by 0 days.

(21) Appl. No.: 10/611,195

(22) Filed: Jul. 1, 2003

Related U.S. Application Data

(60) Provisional application No. 60/393,279, filed on Jul. 2, 2002.

(51) Int. Cl.
*E21B 43/00* (2006.01)

(52) U.S. Cl. ..... 166/372; 166/105; 166/68; 417/60

(58) Field of Classification Search ..... 417/56–60; 166/105, 68, 372; 277/339
See application file for complete search history.

(56) References Cited

U.S. PATENT DOCUMENTS

| | | | | | |
|---|---|---|---|---|---|
| 859,060 | A | * | 7/1907 | Heeter | 277/339 |
| 2,496,546 | A | * | 2/1950 | Lamb | 166/138 |
| 2,676,547 | A | * | 4/1954 | Knox | 417/60 |
| 2,884,861 | A | * | 5/1959 | Renic et al. | 417/59 |
| 3,090,316 | A | * | 5/1963 | Montgomery | 166/372 |
| 4,984,969 | A | | 1/1991 | Fineberg | |

* cited by examiner

*Primary Examiner*—David Bagnell
*Assistant Examiner*—Giovanna Collins
(74) *Attorney, Agent, or Firm*—Martin G. Ozinga; Phillips, McFall, McCaffrey, McVay, & Murrah, P.C.

(57) ABSTRACT

A plunger lift tool and method of using the same in a well having tubing comprising a tubular housing, having a top portion, a bottom portion, and said housing further defines a passageway therein; a positioning means attached to said housing for removably installing said housing in said well tubing; and a selective sealing means attached to said housing for creating a seal between said housing and said well tubing.

6 Claims, 7 Drawing Sheets

PLUNGER LIFT TOOL AND METHOD OF USING THE SAME

CROSS-REFERENCE TO RELATED APPLICATIONS

Priority is claimed from provisional application U.S. Ser. No. 60/393,279 filed on Jul. 2, 2002, and incorporated by reference herein.

BACKGROUND OF THE INVENTION

1. Field of the Invention

In general, the present invention relates to a device and method of recovering fluids from oil and gas wells. More particularly, the present invention increases the production rates in plunger lift wells by converting a single stage plunger lift system to a multiple stage plunger lift system with a new and improved plunger lift tool and method of using the same.

2. Description of the Prior Art

Typically, in plunger lift wells, a single plunger is used to move fluids such as oil and water from below the surface to the surface. Generally, the plunger travels from the lower end of the well to the surface under the propulsion of compressed gas that has been injected from the surface to the bottom of the well or has naturally developed in the well and then under the plunger. As the plunger rises, it lifts a column of fluid accumulated above the plunger to the surface where it is collected. After the fluid is discharged and the plunger has reached a designated height, the gas pressure is reduced and the plunger descends, under the influence of gravity, to the bottom of the well for another load of fluid. When the plunger hits the bottom or contacts fluid in the well, a mechanical valve is activated which then allows the gas pressure to build under the plunger, thus raising the plunger again and with it accumulated fluid.

It is contemplated to convert a single plunger system as described above to a dual stage system which incorporates the use of two plungers. A device referred to as a plunger lift tool, hereinafter referred to as "tool", is incorporated for the conversion in the well and a second plunger added. Generally, the well is divided by the tool such that a plunger is located and operates below the tool and a second plunger is located and operates above the tool.

In operation, the first plunger is sent down the hole. Next, the tool is sent down the hole and selectively and removably positioned at a predetermined location above the first plunger. Finally, a second plunger is then sent down the hole. The positioned tool divides the well into two stages, a first stage for the first plunger to travel and a second stage for the added second plunger to travel. The first stage is defined by the distance of travel from the bottom of the well up to the location where the tool is positioned and the second stage is defined by the positioned tool to the top of the well.

In operation, the first plunger travels from the lower end of the well, through the first stage and pushes the accumulated oil through the tool into the second stage where the second plunger carries the oil to the surface. Although two stages are created with two different plungers in each stage, the basic operation is the same where the plungers rise under pressure and then fall back by gravity. When the first plunger hits the bottom of the well or contacts fluids, a mechanical valve is activated which then allows the gas pressure to build under the first plunger. Likewise, when the second plunger falls and hits the tool or contacts fluids, a mechanical valve is activated which then allows the gas pressure to build under the second plunger. Use of multiple plungers allows for a gas energy pocket under the tool to help lift the load of fluid on the second plunger on the next open cycle of the well.

Many problems are present in the prior art due to the fundamental functional requirements needed in operation of a multi-stage plunger lift system. In order to create the operational stages in the well, the tool must be able to make a seal with the tubing when set in position. Likewise, the seal has to be removably attached so that the tool can be retracted from the well for such things as replacing plungers in the bottom stage, under the tool. Currently, there are no known simple, functional, and cost effective methods in making a necessary seal and allow the tool to be extracted easily from the well.

Another potential limitation is due to the simple fact that different wells configurations cause different needs for creating seals for making separate zones. Some well tubing is connected with collars whereas others have joints. The prior art fails to provide a solution for creating such seals in multiple applications.

Still yet another example of a potential limitation is the difficulty of removing the tool from a well where fluid has accumulated above the tool. Due to the added weight of the standing fluid, the prior art methods associated with the industry do not easily allow removal of the necessary equipment with a slick line and is, thus, less functionally efficient.

Of note, in the current invention, a "plunger" is the device that would actually move up and down in the well whereas a "plunger lift tool" is a reference to the device that essentially is positioned in the well in a removably fixed position and does not travel up and down in the well to push fluids. In some of the prior art patents, such as U.S. Pat. No. 4,984,969 issued Jan. 15, 1991 to Fineberg, the term "plunger lift tool" as used is not to be confused with how the term is used in the current specification. It is believed that the aforementioned patent which is titled "Plunger Lift Tool" is actually what would be considered by the art to be simply a "plunger". For clarity, the current invention uses the term "plunger" to mean the device that moves up and down in the well which is standard in the art. In the current invention, a "plunder lift tool" or "tool" refers to a device that is generally fixed in the well to create multiple zones or areas for multiple plungers to operate within and is a completely separate device from a plunger.

The above discussed limitations in the prior art is not exhaustive. The current invention provides an inexpensive, time saving, more reliable apparatus and method of using the same where the prior art fails.

SUMMARY OF THE INVENTION

In view of the foregoing disadvantages inherent in the known types of plunger lift tools and methods of use now present in the prior art, the present invention provides a new and improved tool and method of use which may be removably positioned in oil and gas wells to create multiple stages for use with multiple plungers. As such, the general purpose of the present invention, which will be described subsequently in greater detail, is to provide a new and improved plunger lift tool and method of using the same which has all the advantages of the prior art devices and none of the disadvantages.

To attain this, the present invention essentially comprises a tool housing generally having a positioning means for removably installing the invention in the tubing of a well, a selective sealing means for creating independent stages in which independent plungers operate respectively, a retrieval assembly for removing the invention from the well, an impact absorbing assembly generally located at the bottom of the invention housing for interaction with a plunger located below the invention, and a second impact absorption means generally located at the top of the tool housing for interaction with a second plunger located above the tool housing.

Furthermore, the present invention essentially comprises a method of determining where in the well the tool housing may be located for optimum performance. It is further contemplated that the invention may include more than one tool housing selectively located in a well to create more than two stages for use with more than two plungers respectively.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved plunger lift tool and method of using the same which may be easily and efficiently manufactured and marketed.

It is a further object of the present invention to provide a new and improved plunger lift tool and method which is of a durable and reliable construction and may be utilized at any depth.

An even further object of the present invention is to provide a new and improved plunger lift tool and method which is susceptible to a low cost of manufacture with regard to both materials and labor, and which accordingly is then susceptible to low prices of sale to the consuming industry, thereby making such tool economically available to those in the field.

Still another object of the present invention is to provide a new and improved plunger lift tool and method which provides all of the advantages of the prior art, while simultaneously overcoming some of the disadvantages normally associated therewith.

Another object of the present invention is to provide a new and improved plunger lift tool and method which may be used interchangeably in wells with collar tubing or joint tubing.

Yet another object of the present invention is to provide a new and improved plunger lift tool and method which provides for a greater inner diameter of flow through the tool and thus reduces the amount of pressure required to move the accumulated fluid upwards.

An even further object of the present invention is to provide a new and improved plunger lift tool and method which allows multiple stages in the well to create bottom hole pressure under each tool where they are positioned, hence allowing to lift same amounts of fluid from shallower depths with less gas and pressure to reach surface with fluid.

Still another object of the present invention is to provide a new and improved plunger lift tool and method that allows pressure testing the tubing in an oil well by dropping a standing valve in the well to the seat nipple.

These, together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the drawings in wherein.

DETAILED DESCRIPTION OF THE PREFERRED EMBODIMENTS

Figure 1:
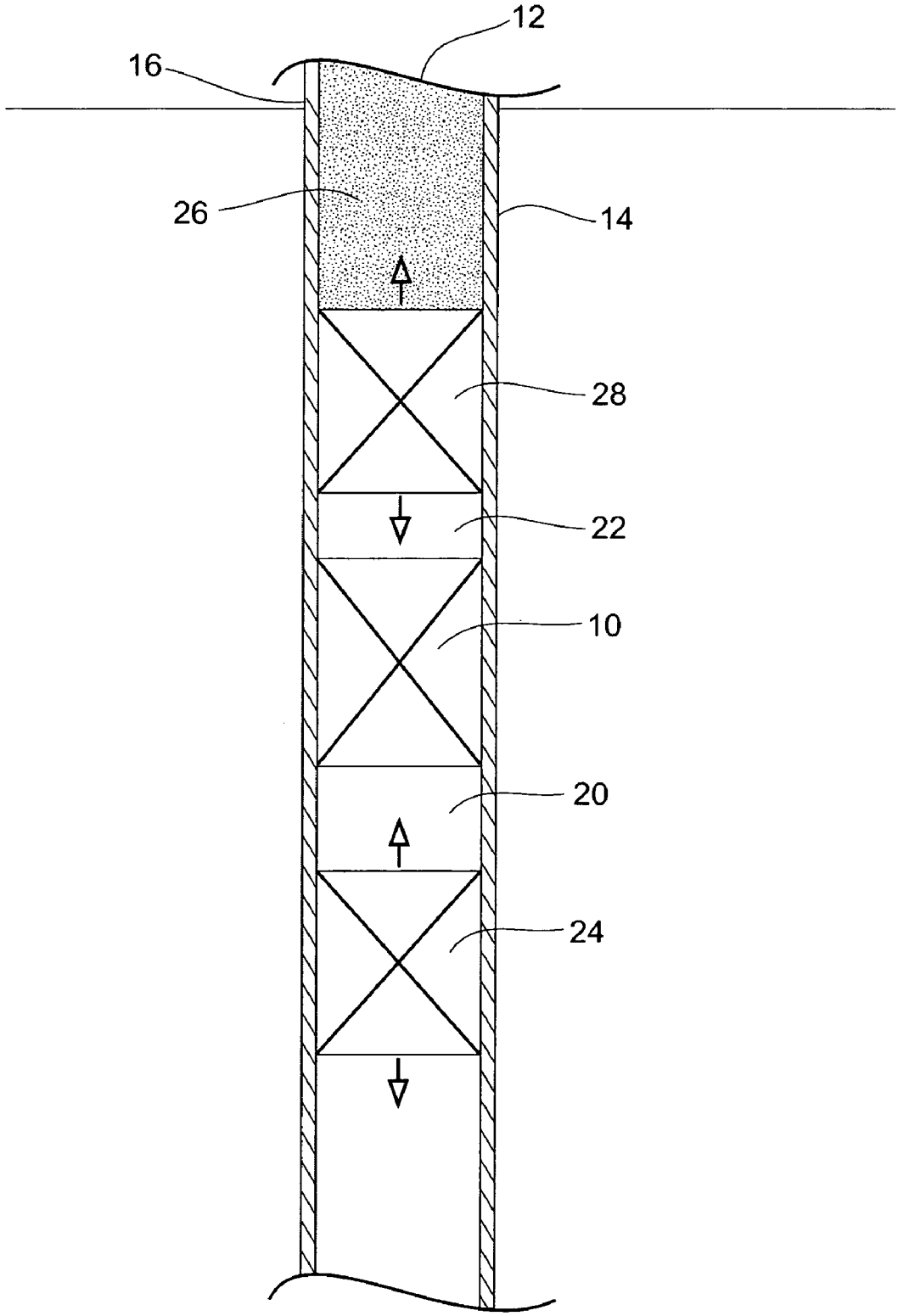
FIG. 1 is a general schematic illustration of a preferred embodiment of the invention in tubing of a well with a plunger in a stage below a plunger lift tool housing and a plunger in a second stage above for illustrative purposes.
Figure 2:
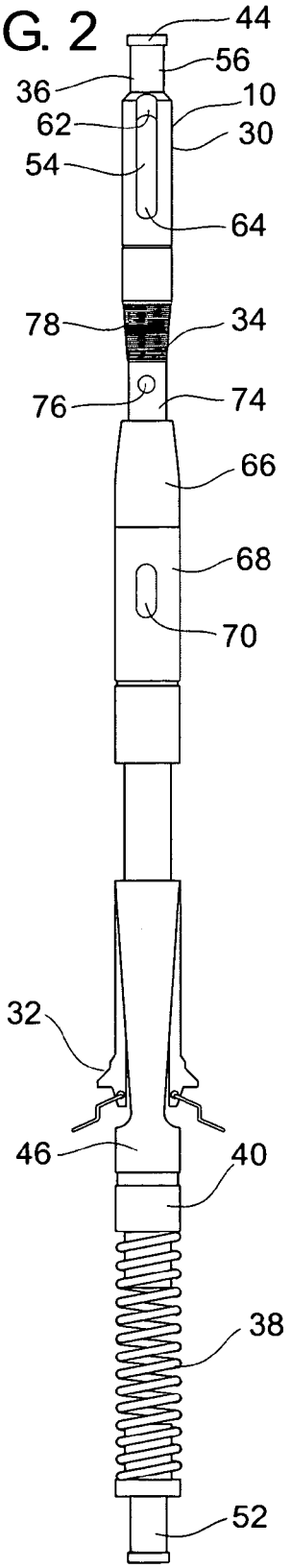
FIG. 2 is a side view of a preferred embodiment of the invention wherein the selective sealing means is not activated; the spreader cone is not engaging or expanding the bushing. Furthermore, the collar stop assembly or tool positioning means is not activated.
Figure 3:
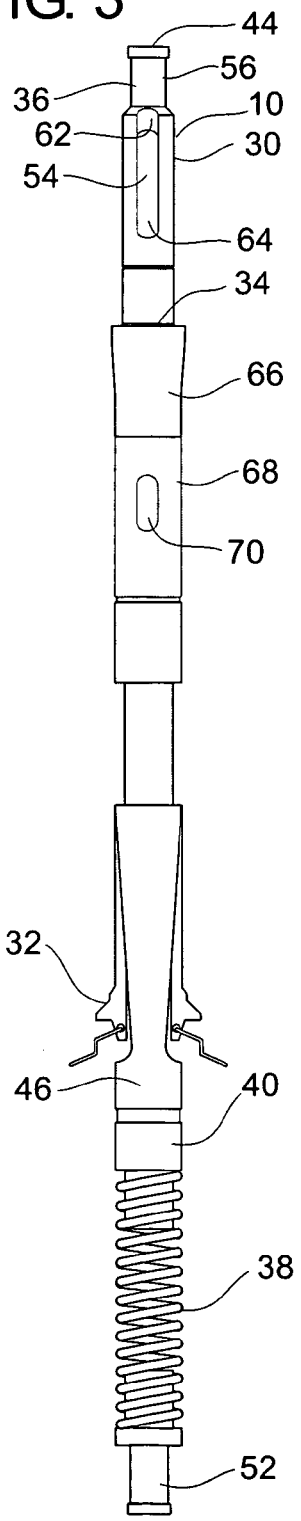
FIG. 3 is a side view of a preferred embodiment of the invention wherein the selective sealing means is activated; the spreader cone is engaging and expanding the bushing. Furthermore, the collar stop assembly or tool positioning means is not activated.
Figure 4:
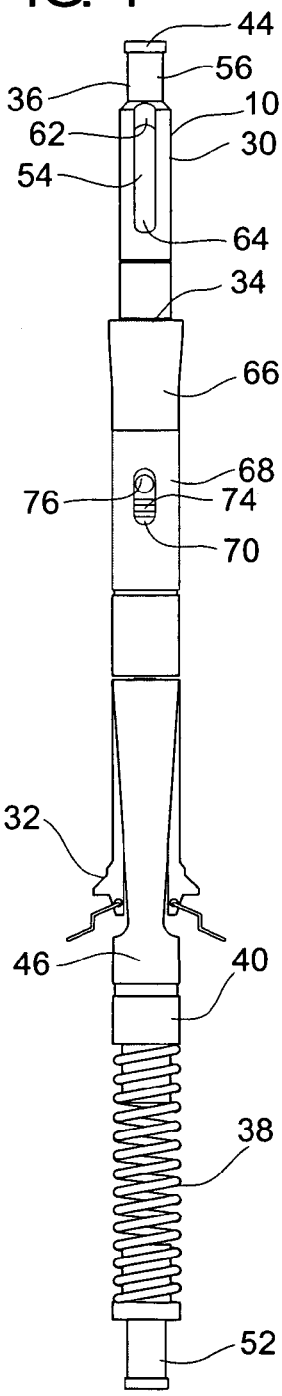
FIG. 4 is a side view of a preferred embodiment of the invention wherein the selective sealing means is activated; the spreader cone is engaging and expanding the bushing. Furthermore, the collar stop assembly or tool positioning means is activated.
Figure 5:
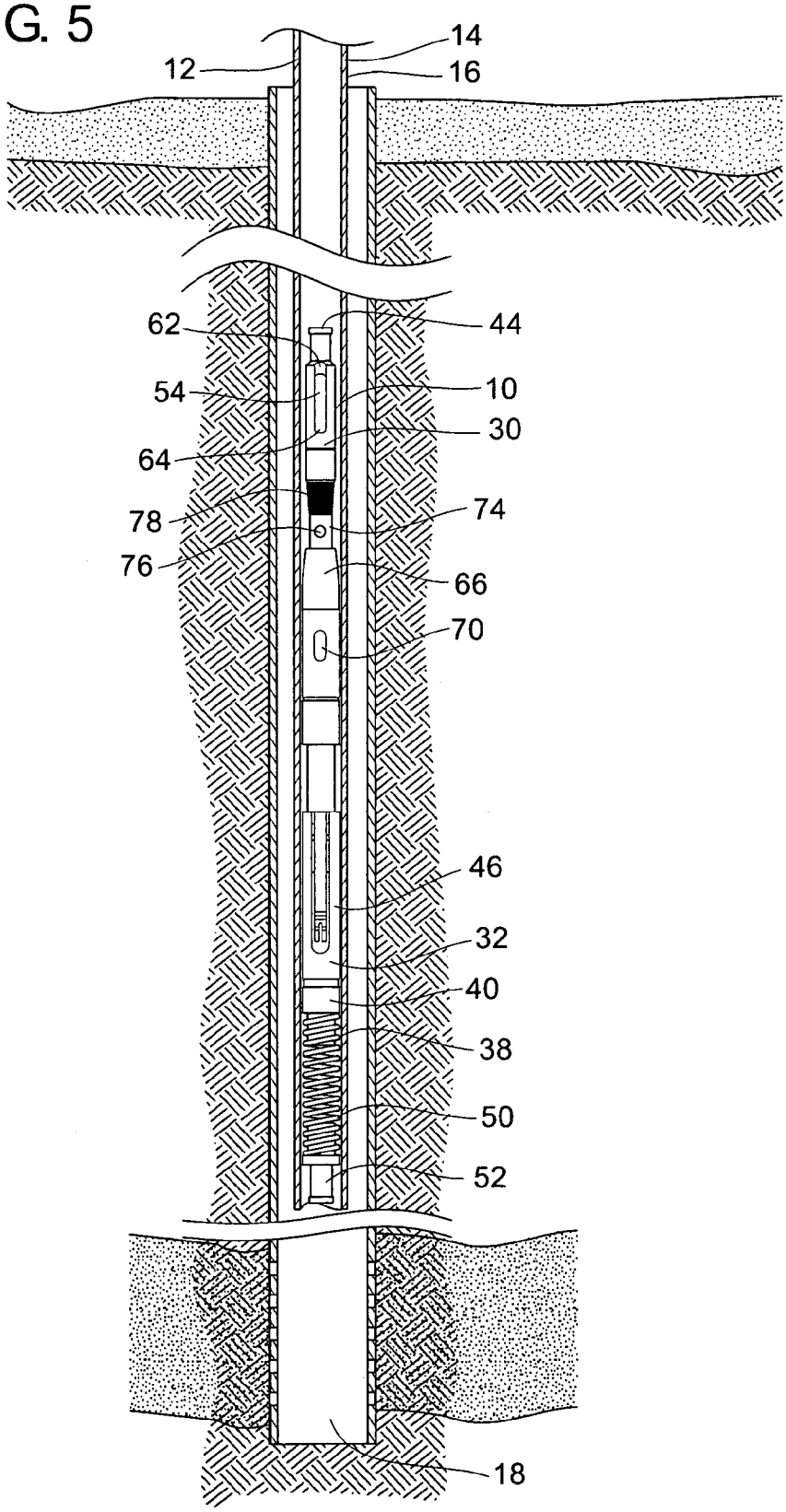
FIG. 5 is a side view of a preferred embodiment of the invention generally depicting positioning in a cross sectional of a well wherein the selective sealing means is not activated; the spreader cone is not engaging or expanding the bushing to create a seal against the tubing. Of note, the collar stop assembly or tool positioning means is generally shown rotated 90 degrees from FIGS. 2, 3 and 4 for purposes of illustration.
Figure 6:
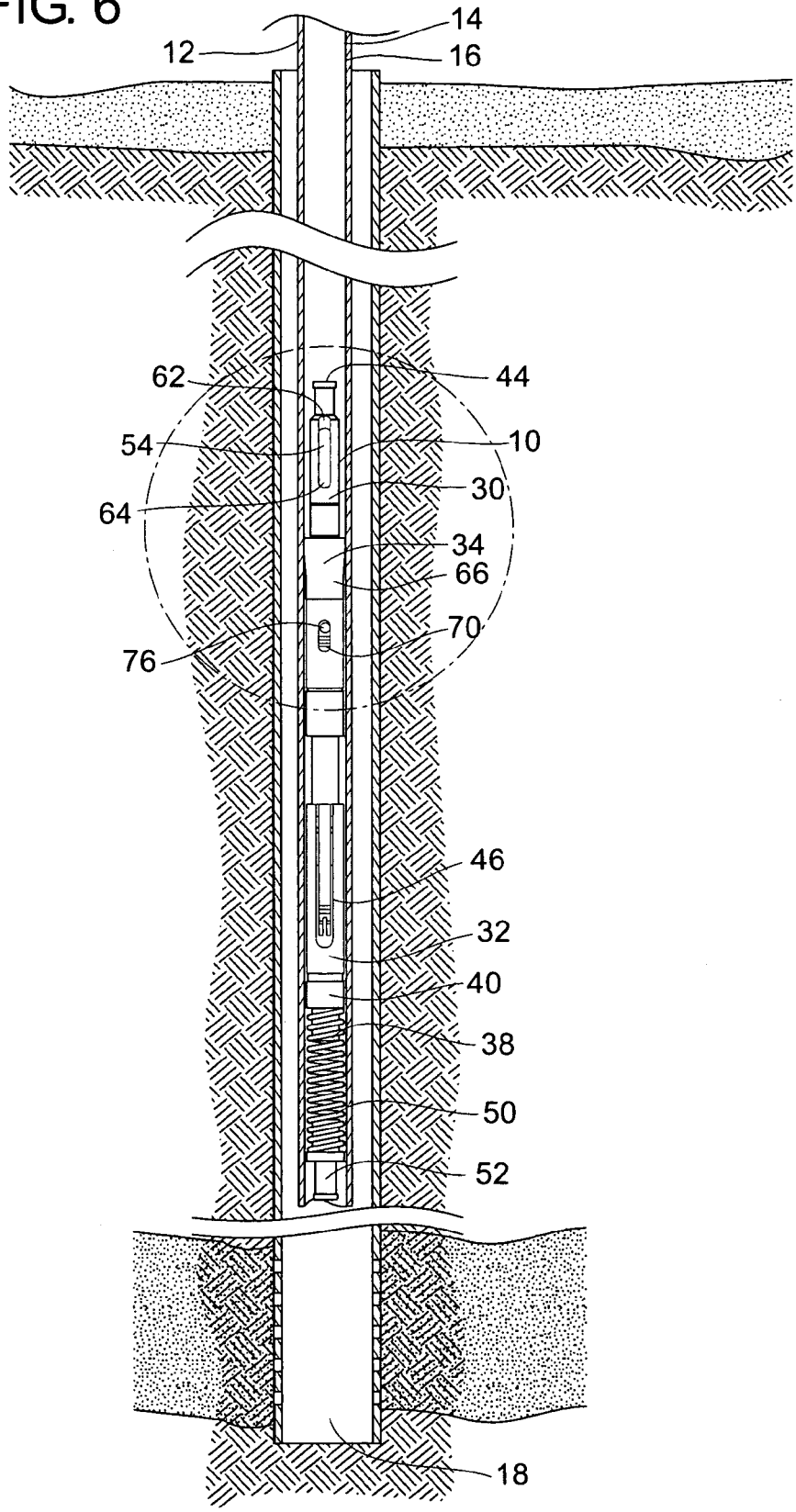
FIG. 6 is a side view of a preferred embodiment of the invention generally depicting positioning in a cross sectional of a well wherein the selective sealing means is activated; the spreader cone is engaging and expanding the bushing to create a seal against the tubing. The collar stop assembly or tool positioning means is generally shown rotated 90 degrees from FIGS. 2, 3 and 4 for purposes of illustration.
Figure 7:
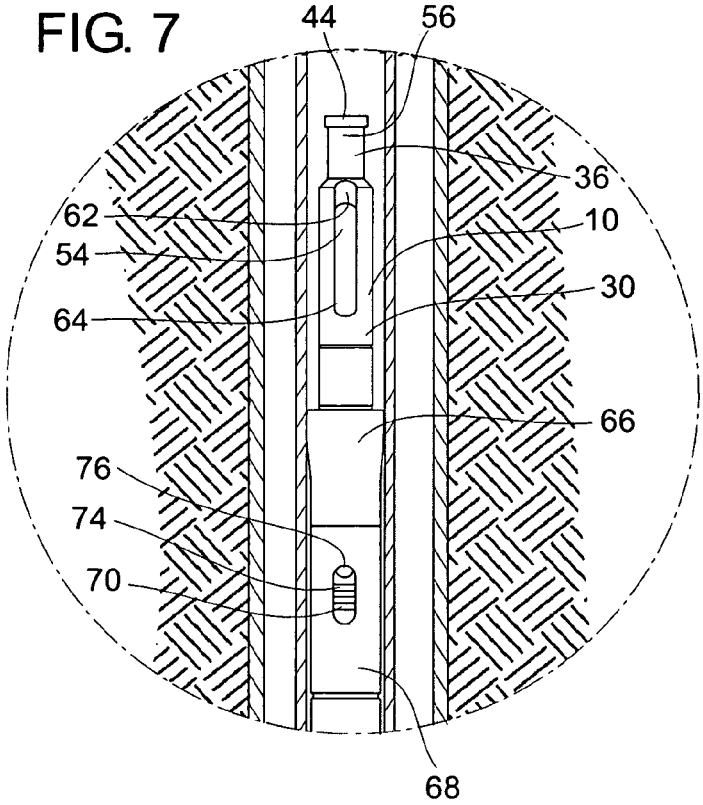
FIG. 7 is an expanded view of an indicated region of FIG. 6 of a preferred embodiment of the invention generally depicting positioning in a cross sectional of a well wherein the selective sealing means is activated; the spreader cone is engaging and expanding the bushing to create a seal against the tubing. The collar stop assembly or tool positioning means is generally shown rotated 90 degrees from FIGS. 2, 3 and 4 for purposes of illustration.
Figure 8:
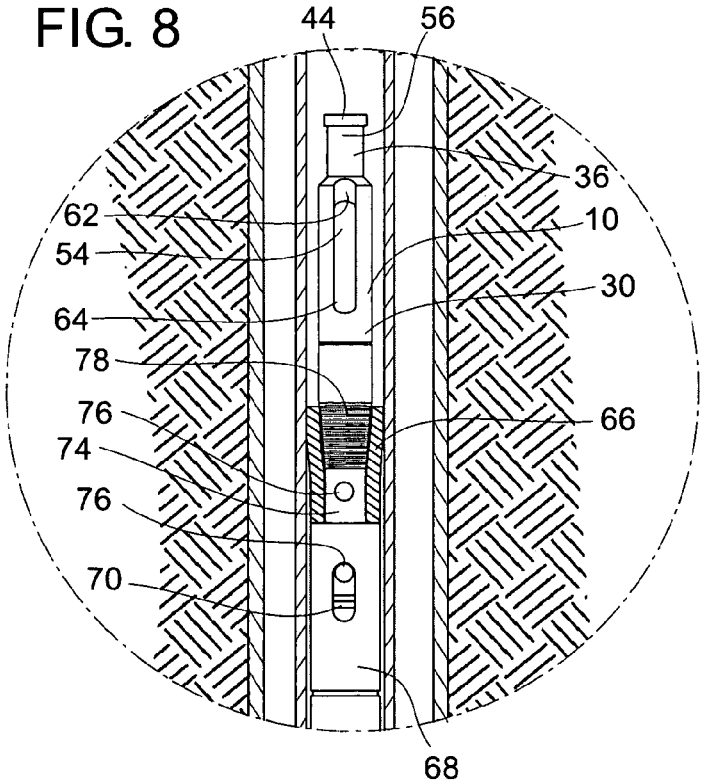
FIG. 8 is an expanded view of an indicated region of FIG. 6 of a preferred embodiment of the invention generally depicting positioning in a cross sectional of a well wherein the bushing is shown in a cross section wherein the selective sealing means is activated; the spreader cone is engaging and expanding the bushing to create a seal against the tubing. The collar stop assembly or tool positioning means is generally shown rotated 90 degrees from FIGS. 2, 3 and 4 for purposes of illustration.
Figure 9:
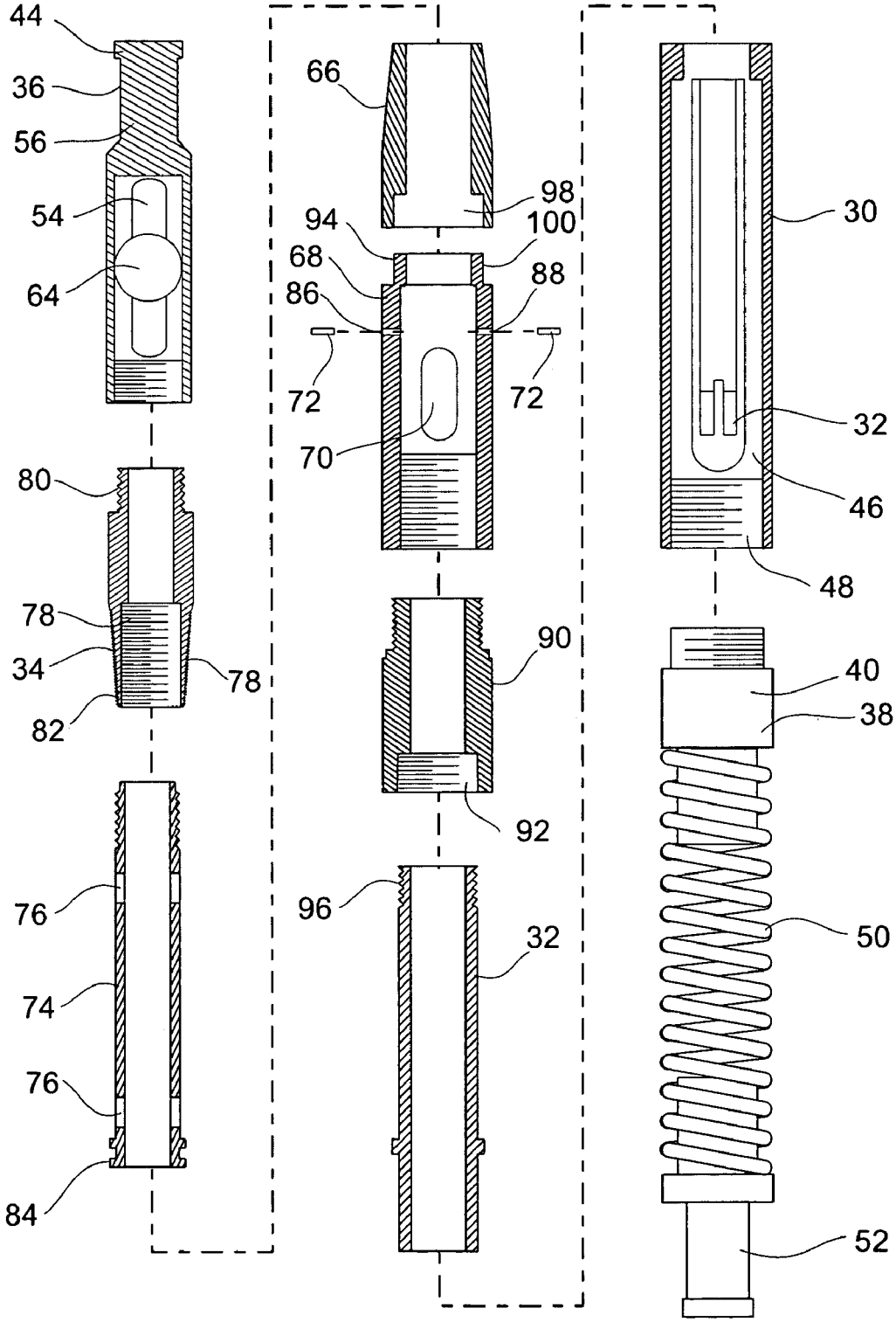
FIG. 9 is an exploded and partial cross sectional illustration of a plunger lift tool in accordance with a preferred embodiment of the invention.
Figure 10:
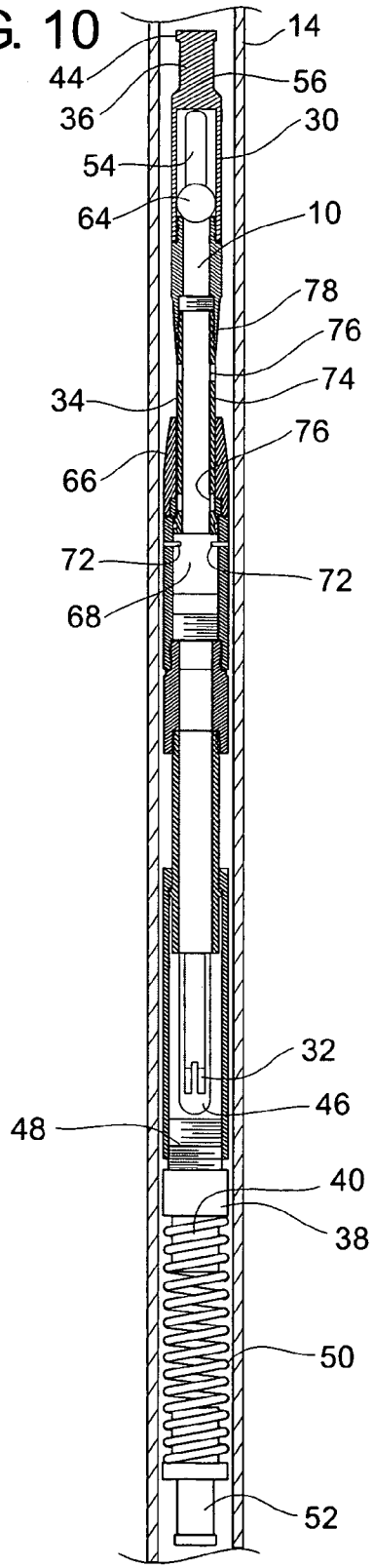
FIG. 10 is a partial cross sectional illustration of a preferred embodiment of the invention in a well wherein the selective sealing means is not activated; the spreader cone is not engaging or expanding the bushing. Furthermore, the collar stop assembly or tool positioning means is not activated to hold the plunger lift tool in position in the tubing. The collar stop assembly or tool positioning means is generally shown rotated 90 degrees from FIGS. 2, 3 and 4 for purposes of illustration.
Figure 11:
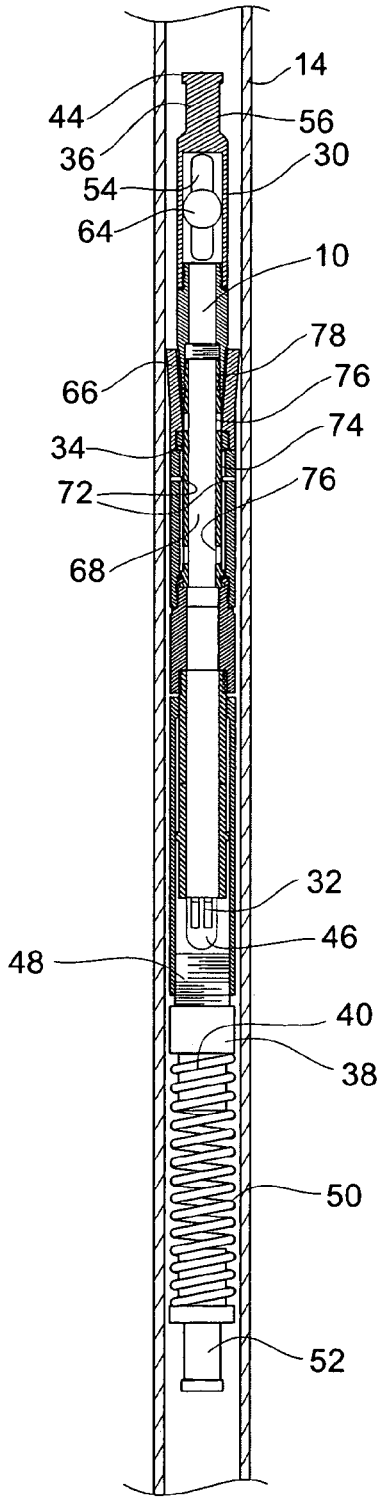
FIG. 11 is a partial cross sectional illustration of a preferred embodiment of the invention in a well wherein the selective sealing means is activated; the spreader cone is engaging and expanding the bushing to create a seal against the tubing. The collar stop assembly or tool positioning means is generally shown rotated 90 degrees from FIGS. 2, 3 and 4 for purposes of illustration and is activated to hold the plunger lift tool in place in the tubing.

Referring to the illustrations, drawings, and pictures, and to FIG. 1 in particular, reference character 10 generally designates a new and improved plunger lift tool and method of using same constructed in accordance with the present invention. Invention 10 is generally used in a well 12 utilizing tubing 14 for the retrieval of hydrocarbons below the surface. It is contemplated that invention 10 may be utilized for other well applications other than hydrocarbon retrieval such as but not limited to water retrieval. Well 12 tubing 14 generally comprises a top 16 at the surface and a bottom 18 where hydrocarbons and or other subterranean fluids enter well 12.

It is contemplated that invention 10 may be used on well 12 that may have tubing 14 connected by collars or joints. It is contemplated that invention 10 may be used on tubing 14 that may be connected by other means other than collars or joints.

For purposes of reference, FIG. 1 generally shows invention 10 in a schematic form located in well 12 tubing 14 such that a first stage 20 and a second stage 22 are created. First stage 20 generally defines the area of travel and operation of a first plunger 24 such that first plunger 24 travels to bottom 18 of well 12 to push accumulated oil 26, water, or the like, into the second stage 22. Second stage 22 generally defines the area of travel and operation of a second plunger 28 which in turn allows oil 26 to accumulate above the second plunger 28 and through applied pressure dispenses the accumulated oil 26 at well 12 tubing 14 top 16 for retrieval.

It is to be noted that it is contemplated that invention 10 may be utilized such that more than two stages of operation are created for more than two plungers respectively. By example, it is contemplated, but not shown in the figures, that two or more of invention 10 may be positioned in well 12 to separate and create more than two independent stages for plungers to operate respectively.

Invention 10 essentially comprises a tubular tool housing 30, defining a flow passageway therein, with a positioning means 32 for removably installing the tool housing 30 in well 12 tubing 14, a selective sealing means 34 for creating independent stages such as first stage 20 and second stage 22 in which first plunger 24 and second plunger 28 operate respectively, a retrieval assembly 36 for removing the tool housing 30 from well 12, a first or lower impact absorbing assembly 38 generally located at the bottom portion or bottom 40 of tool housing 30 for interaction with first plunger 24, and a second or upper impact absorption assembly 42 (not depicted) generally located at the top portion or top 44 of the tool housing 30 for interaction with second plunger 28 located above the tool housing 30.

In a preferred embodiment, positioning means 32 generally removably attaches the tool housing 30 to tubing 14 in such a fashion that the tool housing 30 is locked in place until removal is desired. One such positioning means 32, such as but not limited to, is collar stop assembly 46. Another preferred embodiment not depicted is a three slip stock, tubing stop, for use in well 12 that has heavy wall tubing 14. In a preferred embodiment, collar stop assembly 46 has a three quarter inch inner diameter.

Positioning means 32 may further include adapter 48 for removably attaching a first or lower impact absorbing assembly 38. It is contemplated that positioning means 32 may incorporate lower impact absorbing assembly 38. In a preferred embodiment, positioning means 32 is generally located in bottom 40 of tool housing 30. It is understood that lower impact absorbing assembly 38 may be removably attached, provided separately, not included, or that first plunger 24 may include an impact absorption means. First or lower impact absorbing assembly 38 may generally include a spring 50 and a fish neck 52. It is contemplated that other conventional impact absorption devices may be utilized that do not include spring 50.

In a preferred construction, retrieval assembly 36 is generally located at the top 44 of tool housing 30 and is provided for removing the tool housing 30 from well 12. Retrieval assembly 36 generally includes bypass or flow cage 54 which will be discussed in greater detail below. In a preferred construction, retrieval assembly 36 has a fish neck 56 for attaching to standard down hole retrieval devices. It is further contemplated that a second or upper impact absorption assembly 42 may generally be located at the top 44 of the tool housing 30 for interaction with second plunger 28 located above the tool housing 30. Second or upper impact absorption assembly 42 may generally include a spring 58 (not depicted) and a fish neck 60 (not depicted).

It is understood that second or upper impact absorption assembly 42 may be removably attached, provided separately, not included, or that second plunger 28 may include an impact absorption means. It is contemplated that other conventional impact absorption devices may be utilized that do not include spring 58.

Retrieval assembly 36 generally includes bypass or flow cage 54 which may further include a flow channel 62 for improving vertical flow as opposed to a pure or nearly pure horizontal discharge, and a ball check valve assembly 64 for redirecting flow when the tool housing 30 is being selectively positioned in well 12 tubing 14. It is to be noted that a preferred construction of retrieval assembly 36 is such that a 1 inch inner diameter is achieved. Likewise, the inner diameter may be greater or less. This allows for fluid that may have accumulated above the tool housing 30 to flow through when the tool housing 30 is being taken out of the well 12.

In a preferred embodiment, selective sealing means 34 is utilized for creating independent stages such as first stage 20 and second stage 22 in which first plunger 24 and second plunger 28 operate respectively. Selective sealing means 34 may generally include an expandable bushing 66 with a preferred construction being of natural or man made rubber or other synthetic material. Bushing 66 may be constructed of other materials that allow for expansion and retraction such as but not limited to plastics and other composite materials. Bushing 66 is generally provided on sleeve 68 in a retracted position while the tool housing 30 is being selectively positioned in well 12 tubing 14.

Sleeve 68 generally includes bypass cage 70 and shearing pins 72 and is generally located on shaft assembly 74 such that sleeve 68 may operatively travel on shaft assembly 74 as is described in further detail below. Shaft assembly 74 may further include bypass cage 76 and spreader cone 78 and is generally positioned between retrieval assembly 36 and collar stop assembly 46. In a preferred construction, connector 80 is utilized to matingly and removably connecting shaft assembly 74 to retrieval assembly 36. It is contemplated that retrieval assembly 36 and shaft assembly 74 may be of a single body construction.

Shearing pins 72 generally hold sleeve 68 in place on shaft assembly 74 until tool housing 30 is positioned. After tool housing 30 is positioned, a downward force is applied to the tool housing 30 such that shearing pins 72 are broken, thus allowing sleeve 68 to travel on shaft assembly 74 so that spreader cone 78 engages bushing 66.

In a preferred embodiment, spreader cone 78 has grooves 82 for frictionally engaging bushing 66. As spreader cone 78 travels inside bushing 66, bushing 66 expands generally outward for creating a seal against well 12 tubing 14. When it is desired to remove tool housing 30 from well 12 tubing 14, an upward force is applied to tool housing 30 such that sleeve 68 is free to travel on shaft assembly 74 and spreader cone 78 disengages bushing 66. Bushing 66 may then return to its original shape and diameter which allows fluid to travel between the bushing 66 and tubing 14.

In a preferred construction, shearing pins 72 are made from a generally soft metal such as but not limited to brass and are located in shaft assembly 74 groove 84 and sleeve 68 holes 86 and 88. It is contemplated that other types of material such as but not limited to plastic may be used for shearing pins 72.

A preferred embodiment may include adapter 90 for removably attaching sleeve 66 to positioning means 32. It is contemplated that positioning means 32 may be constructed to include the sleeve 66. Adapter 90 is generally constructed such that threads 92 and 94 mate to positioning means 32 top portion 96 and sleeve 66 bottom portion 98. Also of note, it is contemplated that bushing 66 may be removably attached to sleeve 68 by connector 100.

IN OPERATION

In a preferred method of operation, tool housing 30 is located in well 12 tubing 14 after a first plunger 24 is sent down hole. In a preferred method, tool housing 30 is set at about 27% to 28% of the well length, as defined by bottom 18 of well 12 tubing 14 to the top 16 of tubing 14, above the bottom 18 of tubing 14 in well 12. It is understood that if fluid levels are higher in well 12, tool housing 30 may be located higher in the well 12 and, likewise, if fluid levels are lower in well 12, tool housing 30 may be located lower in the well 12. It is contemplated that invention 10 may be located in a well 12 at various points and should not be considered limited to a particular position in well 12.

Tool housing 30 is set by selectively activating positioning means 32 and then applying a downward force such that shearing pins 72 brake allowing sleeve 68 to travel in a manner that bushing 66 engages spreading cone 78 as sleeve 68 travels on shaft assembly 74. Bushing 66 deforms as it communicates with spreading cone 78 creating a seal between tubing 14.

During retrieval of tool housing 30, sleeve 68 travels in such a fashion that spreading cone 78 disengages bushing 66 by a pulling means applied to tool housing 30. Once disengaged, bushing 66 returns to its original shape and allows fluid to travel around the bushing 66.

It is contemplated that more than one tool housing 30 may be utilized in well 12. In a preferred operation not depicted, a fist plunger 24 is sent down hole, then a tool housing 30 is selectively positioned about 27% from the bottom 18. After a second plunger 28 is placed down hole, a second tool housing **30*a* is positioned at about 27% above the first tool housing 30 as defined by the distance from the first tool housing 30 to the top 16. It is further contemplated that more than two tool housings 30 and 30*a*** may be utilized and various depths creating multiple stages for multiple plungers.

Changes may be made in the combinations, operations, and arrangements of the various parts and elements described herein without departing from the spirit and scope of the invention.

I claim:

1. A multiple stage plunger lift tool for use in a well having tubing: comprising:

a shaft assembly defining a passageway therein having a top, a spreader cone, and a bottom, a sleeve defining a passageway therein having a top with an expandable bushing and a bottom a positioning means defining a passageway therein for removably installing said plunger lift tool in said well tubing, said positioning means attached to said bottom of said sleeve;

at least one shear pin for selectively holding said shaft assembly in position with said sleeve wherein said at least one shear pin breaks when a downward force is applied to said top of said shaft assembly allowing said shaft assembly spreader cone to cooperate with said expandable bushing of said sleeve thereby creating a seal between said plunger lift tool and said well tubing; and a retrieval assembly attached to said top of said shaft assembly for removing said tool from said well wherein said retrieval assembly includes a bypass cage with a ball check valve therein.

2. The plunger lift tool of claim 1 wherein said retrieval assembly further includes a fish neck.

3. The plunger lift tool of claim 1 that further includes a first impact absorbing assembly attached to said positioning means.

4. The plunger lift tool of claim 1 wherein said bushing is made from a synthetic material.

5. The plunger lift tool of claim 1 wherein said bushing is made from rubber.

6. The plunger lift tool of claim 1 wherein said expandable bushing is retractable from said spreader cone when an upward force is applied to said tool thereby removing said seal between said tool and said well tubing.

* * * * *